US007997942B2

(12) United States Patent
Dowman

(10) Patent No.: US 7,997,942 B2
(45) Date of Patent: Aug. 16, 2011

(54) CABLE CONNECTOR DEVICE FOR A BATTERY

(76) Inventor: Kevin Patrick Dowman, Whakatane (NZ)

( * ) Notice: Subject to any disclaimer, the term of this patent is extended or adjusted under 35 U.S.C. 154(b) by 0 days.

(21) Appl. No.: 12/090,831

(22) PCT Filed: Oct. 20, 2006

(86) PCT No.: PCT/NZ2006/000271

§ 371 (c)(1),
(2), (4) Date: Apr. 18, 2008

(87) PCT Pub. No.: WO2007/046720

PCT Pub. Date: Apr. 26, 2007

(65) Prior Publication Data

US 2008/0254686 A1 Oct. 16, 2008

(30) Foreign Application Priority Data

Oct. 21, 2005 (NZ) ..... 543130

(51) Int. Cl.
*H01R 4/42* (2006.01)

(52) U.S. Cl. ..... 439/762; 439/754

(58) Field of Classification Search ..... 439/754, 439/388, 428, 504, 522, 726, 762, 765, 766
See application file for complete search history.

(56) References Cited

U.S. PATENT DOCUMENTS

| | | | | | |
|---|---|---|---|---|---|
| 1,720,067 | A | * | 7/1929 | Weisgerber | 439/759 |
| 2,832,616 | A | * | 4/1958 | Morse | 277/565 |
| 2,844,806 | A | * | 7/1958 | McKissick | 439/522 |
| 4,062,613 | A | * | 12/1977 | Tritenne | 439/388 |
| 4,623,212 | A | | 11/1986 | Hogan, Sr. | |
| 6,902,444 | B1 | | 6/2005 | Shannon, Jr. | |

FOREIGN PATENT DOCUMENTS

| | | |
|---|---|---|
| GB | 713 800 | 0/1954 |
| GB | 9617 | 0/1911 |

* cited by examiner

*Primary Examiner* — Edwin A. Leon
*Assistant Examiner* — Vanessa Girardi
(74) *Attorney, Agent, or Firm* — Bio Intellectual Property Services (Bio IPS) LLC; O. (Sam) Zaghmout

(57) ABSTRACT

This invention relates to a cable connector device for use on a battery terminal post, the cable connector including a conductive mounting cap having an internal mounting wall with a surface area corresponding with the surface area of a said battery mounting post to enable, in use, the cap to be mountable over the said battery mounting post, the mounting cap including a cable mounting post integral with or attachable to the mounting cap, the cable mounting post being adapted with a cable fastening means, in use, to receive and fasten an electrical cable thereto.

12 Claims, 5 Drawing Sheets

CABLE CONNECTOR DEVICE FOR A BATTERY

TECHNICAL FIELD

This invention relates to devices for use in mounting electrical cables to battery terminal mounting posts. More particularly, but not exclusively, the present invention relates to a conductive cable connector adapted to mount an electrical cable to the terminal post of a battery.

BACKGROUND ART

Conventional electrical connectors are in the form of a clamp to which the electrical cable is attached. The clamp is mounted to a battery mounting post by means of a bolt and nut fastener or spring loaded scissor arms that exert clamping pressure to keep the electrical cable in contact with the mounting post. There are a number of disadvantages with these types of clamps or connectors including the application of an uneven pressure or over tightening of the clamp about the mounting post that can result in breakages or failure of the electrical joint. More particularly, the clamps can crack or break if the bolt is over tightened or uneven pressure is applied, the thread of the nut can strip, and the thread on the bolts over time can corrode making it difficult to exert the light amount of pressure on the clamp. These potential problems can result in poor electrical contact that can lead to a failure in the electrical connection, corrosion of the bolt or the clamp, burning of the post or arcing that is considered hazardous and which can cause failure of the connection and damage to the battery.

It is a non-limiting object of the invention to provide a cable connector device that overcomes at least some of the above-mentioned problems or at least to provide the public with a useful choice.

SUMMARY OF THE INVENTION

The following statements are intended to form part of, and are integral with, the description to describe various configurations and arrangements of the device of the invention.

According to a non-limiting aspect of the invention there is provided a cable connector device for use on a battery terminal post, the cable connector including a conductive mounting cap having an internal mounting wall with a surface area corresponding with the surface area of a said battery mounting post to enable, in use, the cap to be mountable onto the said battery mounting post, the mounting cap including a cable mounting post integral with or attachable to the mounting cap, the cable mounting post being adapted with a cable fastening means, in use, to receive and fasten an electrical cable to the device.

Preferably the inner wall of the mounting cap is provided with a female thread on the inner wall of the mounting cap that is configured and arranged, in use, to cut an opposing thread on at least a portion of the terminal post and firmly attach the mounting cap to the terminal post, the post being sufficiently malleable such as to allow the opposing thread to be formed.

Desirably the inner wall of the mounting cap is provided with at least one slot in the mounting cap, in use, to enable the cap to be mountable on a terminal post that does not have a uniform cross section along the length of the mounting post.

Preferably the inner wall of the mounting cap is provided with three or four spaced apart longitudinal slots in and about the mounting cap, in use, to enable the cap to be mountable on a terminal post that does not have a uniform cross section along the length of the mounting post.

Preferably the cable mounting post is circular in cross section and provided with an external thread adapted to receive a nut with an opposing thread for securing an electrical cable thereto.

Optionally the cable mounting post is substantially vertically aligned above the longitudinal axis of the mounting post.

Advantageously the cable fastening means is a fastening nut having an outer surface, the outer surface being provided with a non-conductive layer substantially about the outer surface of the fastening nut.

Optionally the fastening nut is made of a durable and resilient non conductive material.

Alternatively the mounting cap is provided with an external thread adapted to receive a ferrule nut with an opposing internal thread, in use, for securing the mounting cap to the terminal post. Desirably the ferrule nut having an outer surface, the outer surface being provided with a non-conductive layer substantially about the outer surface of the fastening nut.

Alternatively, the ferrule nut is made of a durable and resilient non conductive material.

BRIEF DESCRIPTION OF THE DRAWINGS

Preferred embodiments of the invention will now be illustrated, by way of example only, with reference to the accompanying drawings in which.

DETAILED DESCRIPTION OF THE DRAWINGS

Figure 1:
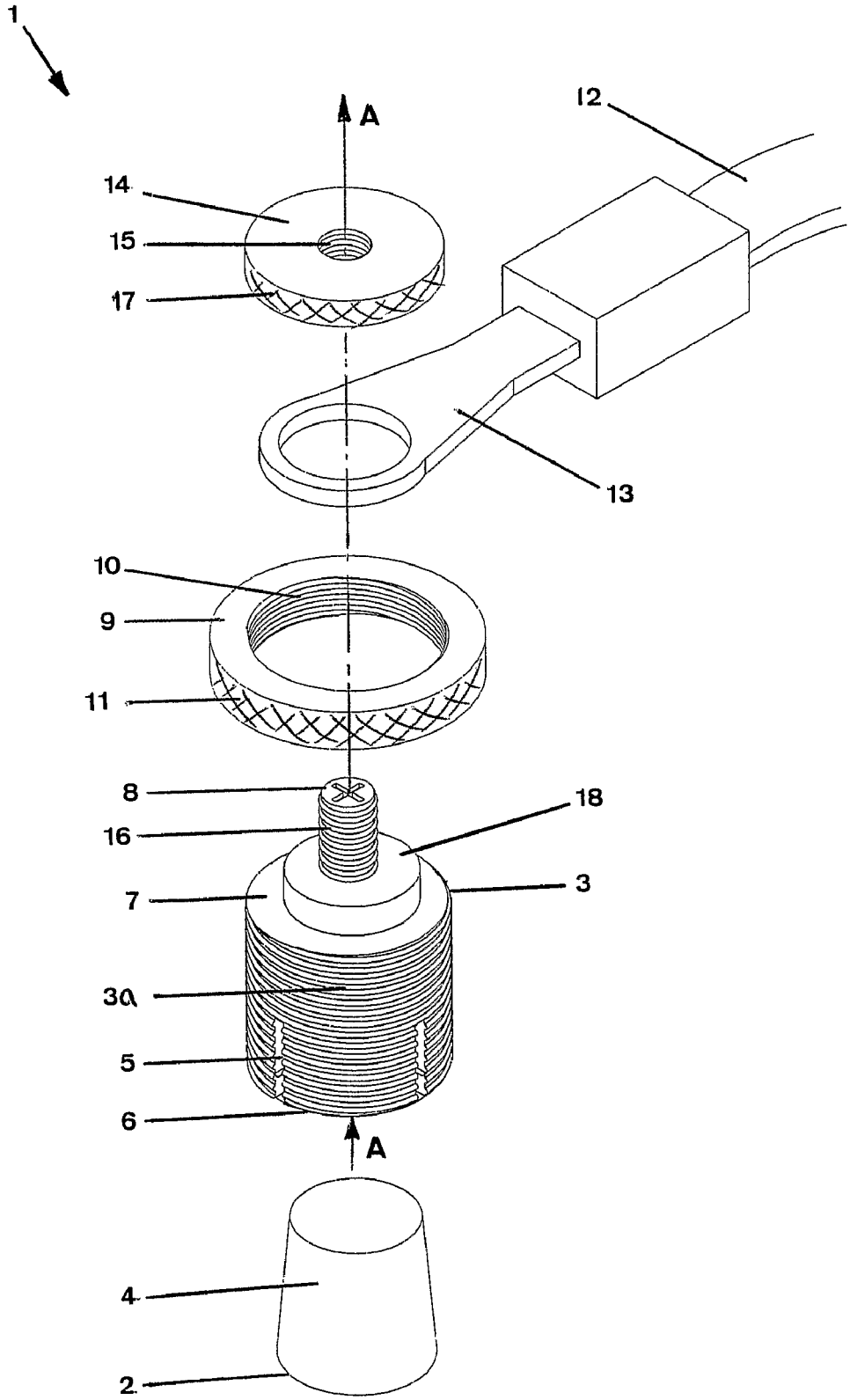
FIG. 1: Shows an exploded view of a cable connector device according to one preferred embodiment of the invention.
Figure 2:
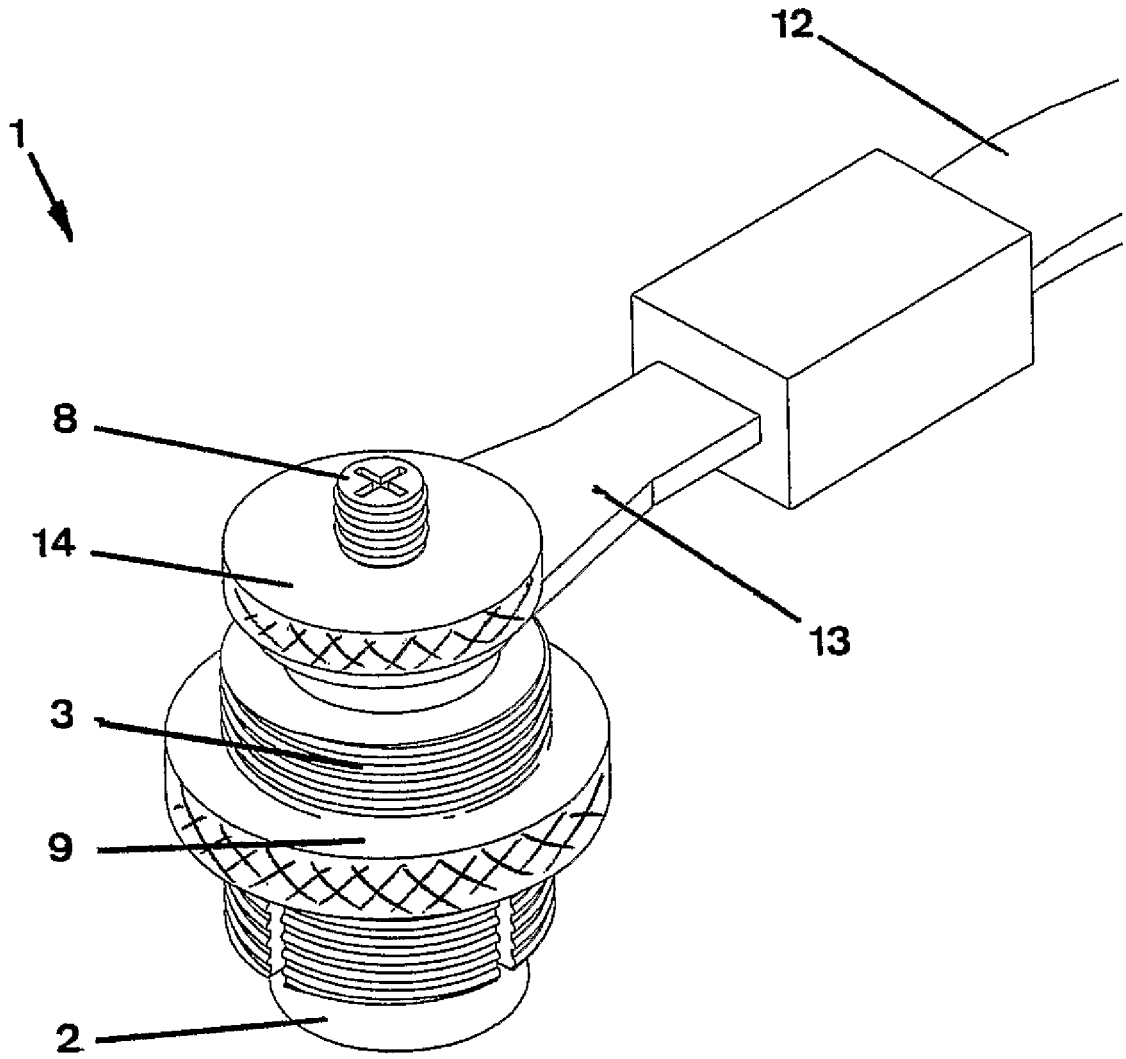
FIG. 2: Shows a perspective view of the, cable, connector device of FIG. 1 as assembled.

Referring to FIGS. 1 and 2, a cable connector device, generally referred to as 1, according to one preferred embodiment of the invention, is illustrated.

The cable connector device 1 is configured and arranged for use on a terminal post 2 of standard and known types of batteries, the details of which as not shown. Such batteries are so well known in the industry for use in vehicles and electrical supplies that they do not need to be further detailed or described in this specification. The terminal post 2 is usually substantially vertically aligned and is generally made of a conductive material with an outer surface that is typically either tapered toward the top (as seen in FIG. 1) or cylindrical with a uniform cross section (not shown). The conductive material of the post 2 is typically composed of a soft and malleable metal such as lead alloy.

The device 1 includes an elongate conductive mounting shroud or cap 3 having an internal mounting wall that is desirably of a shape that allows for the cap 3, in use to be placed over the outer side surface 4 of the post 2 and allows for the cap 3 to be compressed and/or clamped and/or fastened to the post 2 by any suitable form of compressing or clamping means, and in this embodiment the means of attachment is by a ferrel/ferrule nut 9 with an internal thread 10 being screwed onto an opposing thread 3*a* provided on the outer surface of the cap 3.

The mounting cap 3 is desirably provided with at least one longitudinal slot 5 running from the lower rim 6 of the cap 3 up toward the shoulder 7 of the cap 3 as shown. The slot 5 can be of any desirable length, and in this embodiment is of a sufficient length to optionally allow a compressive force to be applied to slightly deform the cap 3 and shape it to suitably fit over a tapered post 2 to achieve a desirable and effective electrical connection of the cap 3 to the post 2.

Preferably at least one slot 5 is desirably provided substantially in parallel with the longitudinal axis A-A of the cap 3. More preferably three or four spaced apart slots 5 are provided through the wall in the cap 3 as shown. The slots 5 may be equidistantly spaced apart although it will be appreciated that this arrangement is not essential and is purely optional but desirable. The slots 5 are seen in these figures as being substantially vertically aligned, although it will be appreciated that the slots 5 can also be provided at a transverse angle to the longitudinal axis A-A of the cap 3 as required or desired. Further, FIGS. 3 to 5 do not show the slots but it will be appreciated that these other embodiments may be provided with this desirable feature, as required or preferred.

The cap 3 includes a cable mounting post 8 being either integral with or attachable to the mounting cap 3 using any known engineering process, and in this embodiment is shown as being integral with the cap 3. Further, the cable mounting post 8 can be configured and arranged to project from the body portion of the cap 3 at any desirable angle, such as any angle between 0 and 90 degrees from the vertical, and as shown, the post 8 projects upwards along the longitudinal axis A-A. The cable mounting post 8 may be of a sufficient length to allow at least one nut to fit over the post 8, with a second nut advantageously serving as a lock nut or to clamp a second electrical cable in place on the cap 3.

In operation, the cap 3 is placed over the outer surface 4 of the post 2, and the ferrule nut 9 with an opposing or corresponding internal thread to the outer thread provided in the cap 3, is screwed onto the opposing thread provided about the cap 3 to compress and clamp the cap 3 firmly to the terminal post 2. The nut 9 may optionally be formed from any durable and resilient non-conductive material.

Desirably the nut is provided with a leverage means to increase the purchase on the nut 9 to make it easier to apply sufficient hand and/or tool force to clamp the nut 9 over the cap 3. The leverage means to increase purchase or mechanical advantage can include having a suitable knurling pattern 11 provided on the outer surface of the nut 9 to hand tighten the nut 9 about the cap 3. Alternatively it will be appreciated that the shape of the nut 9 may be say square or hexagonal to facilitate tightening by application of a hand operated spanner or the like. Further, the leverage means can alternatively be formed with projecting members that project out from the central portion of the nut 9—similar to the advantage with the wings on a wing nut.

Once the nut 9 firmly attaches the cap 3 to the post 2, an electrical cable 12, which may be as shown being crimped to a circular cable lug 13 with a suitable aperture in the lug 13 to fit over the lug locator 18, is placed over the cable mounting post 8 and lug locator 18 and a cable fastening means desirably in the form of a clamp nut 14 with a suitable female internal thread 15 is screwed onto an opposing male thread 16 on the cable mounting post 8. The clamp nut, 14 may be formed from any durable and resilient non-conductive material which is advantageously when removing the nut 14 by hand to remove tie electrical cable 12 from the post 2.

The clamp nut 14 is desirably provided with a leverage means to increase the purchase on the nut 14 in the form of a knurling pattern 17 on the outside surface of the clamp nut 14. The knurling increases friction on the outer surface of the nut 14 and aid, in use, the tightening and loosening of the nut 14 onto the post 8 as required from time to time. Alternative leverage means as previously described can be applied.

The clamp nut 14 can be replaced by a wing nut, or other such nut that can be hand and/or tool tightened to securely clamp; the cable 12 or cable lug 13 to the cable, mounting post. It will be appreciated that a spring washer or second locking nut may be applied over the post 8 to increase the integrity of the device when in operation.

The assembled view of the device 1 is clearly seen in FIG. 2.

Figure 3:
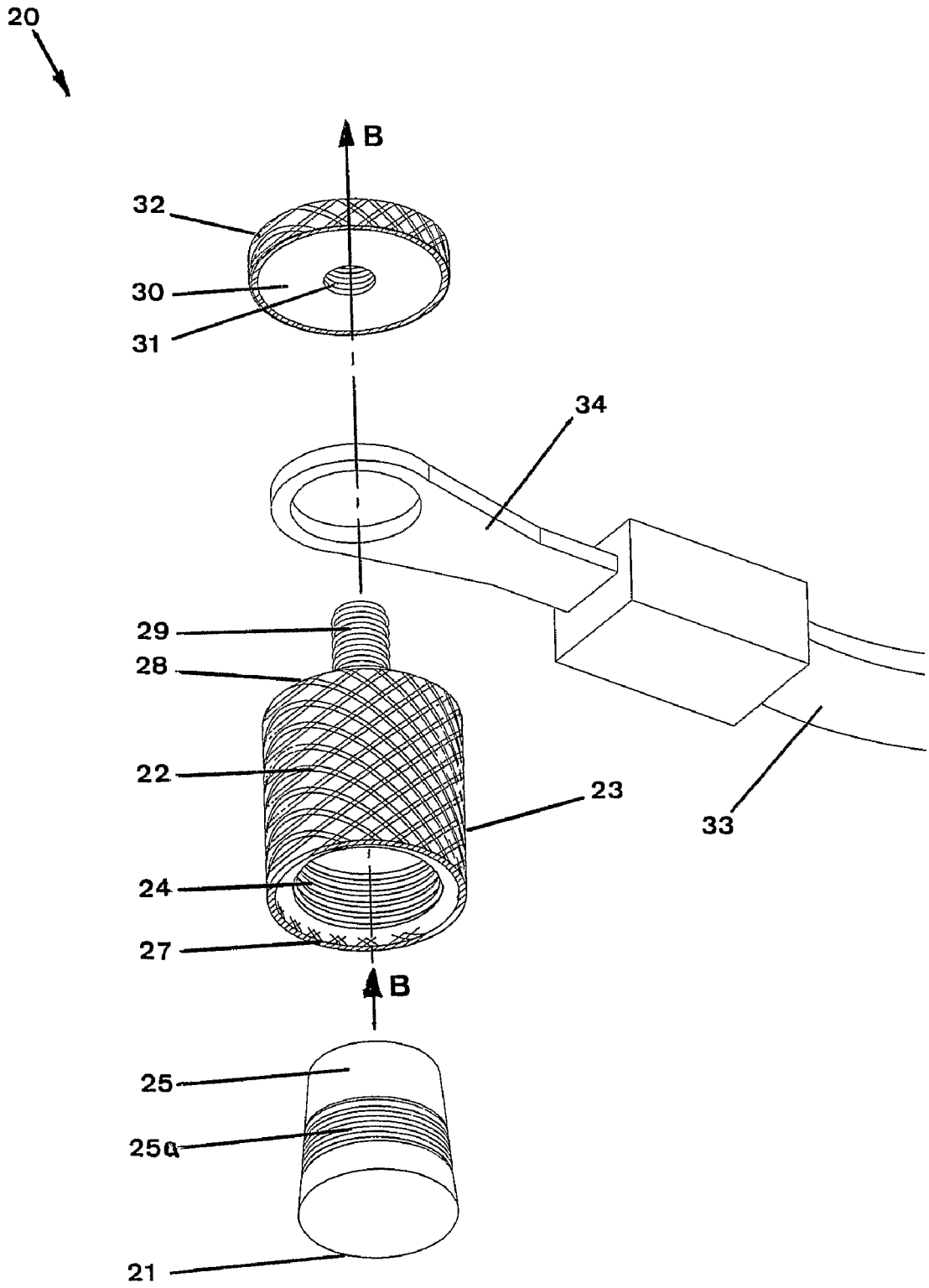
FIG. 3: Shows an exploded view of a cable connector device according to a second preferred embodiment of the invention.
Figure 4:
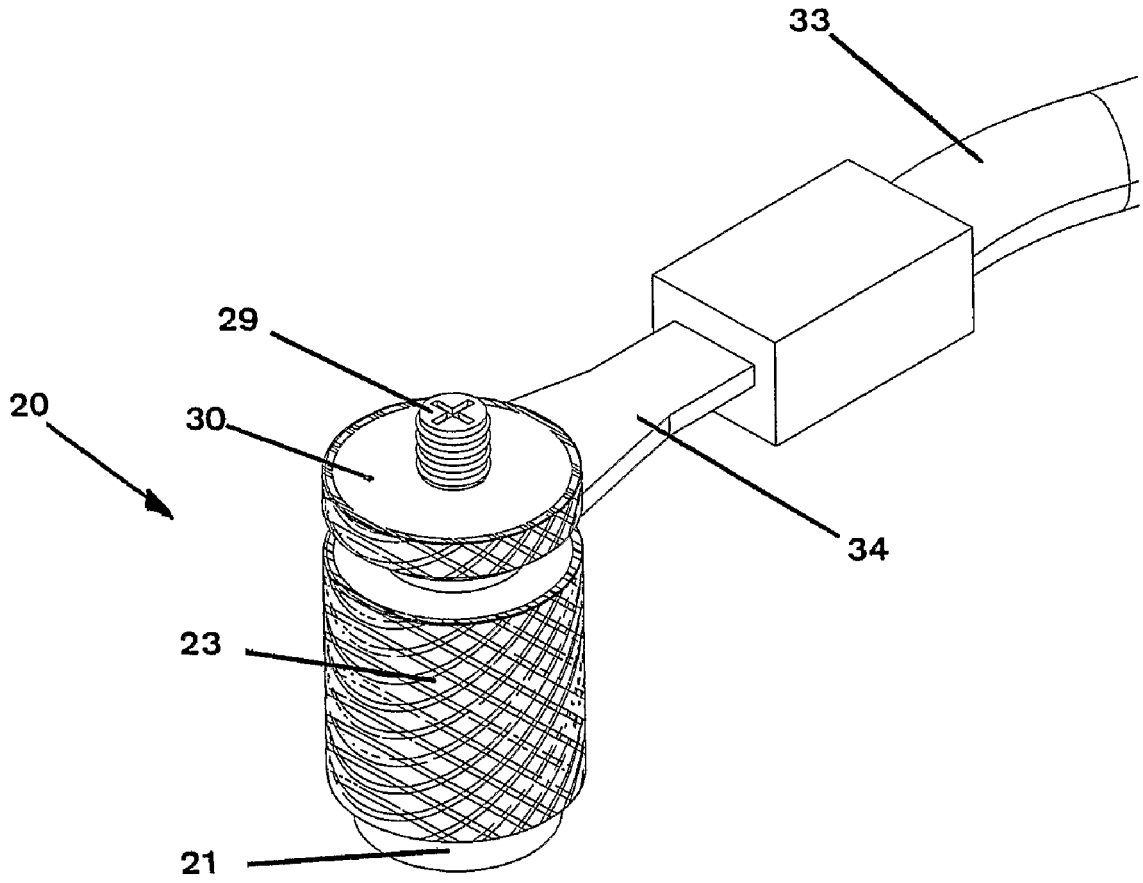
FIG. 4: Shows a perspective view of the cable connector device of FIG. 3 as assembled.

Referring to FIGS. 3 and 4, a cable connector device, generally referred to as 20, according to a second preferred embodiment of the invention, is illustrated.

Many of the components and features of this embodiment are similar to the first preferred embodiment and will not be necessarily repeated, although it will be appreciated that components can be interchangeable and configured in a number of different arrangements as required.

The cable connector device 20 is designed and adapted for use on a terminal post 21 of standard and known types of batteries. Only the terminal post 21 of the battery is shown in the figures, although it will be appreciated by those in the art that the post 21 forms part of the electrical circuit of the battery, the main part of the battery being omitted from the figures for reasons of clarity and simplicity. The conductive material of the post 21 is usually and desirably of a relatively soft and malleable metal such as lead alloy.

The device 20 includes an elongate conductive mounting cap 23 having an internal mounting wall with an internal thread 24 that is configured and arranged, in use, to allow for the cap 23 to cut an external thread on the malleable or relatively soft outer surface 25 of the post 21 to fasten the cap 23 onto the post 21. It will be appreciated that to cut such a thread, and retain the cap 23 securely on the post 21, the internal diameter of the female or internal thread 24 of the cap 23 should be sufficiently close to the diameter of the outer surface 25 of the post 21 for a male external thread 25*a* to be cut on the post 21.

The mounting cap 23 is not shown with a longitudinal slot which could be formed or cut from the lower rim 27 of the cap 23 up toward the shoulder 28 of the cap 23, and which may be similar to that seen in FIG. 1. Optionally the cap 23 is provided with a knurling pattern 22 on the cap 23 to provide additional friction on the outer surface of the cap 23 to facilitate hand tightening of the cap 23 on the post 21.

The cap 23 includes a cable mounting post 29 being either integral with or attachable to the mounting cap 23, and in this embodiment is shown as being integral with the cap 23. Further, the cable mounting post 29 can be configured and arranged to project from the cap 23 at any desirable angle, such as between 0 and 90 degrees from the vertical. However, in this embodiment as shown, the post 8 projects upwards along the longitudinal axis B-B. A suitable external thread is provided on the post 29, such male external thread being matched by an opposing female internal thread 31 in the clamp nut 30. A suitable knurling pattern 32 is desirably provided on the outer surface of the clamp nut 30 to facilitate hand tightening of the nut 30 about the cap 23.

In operation, the cap 23 is placed over the outer surface 25 of the post 23, and then an applied rotational force is applied to enable the internal thread 24 to cut an external thread 25*a* on the post 21 to secure the cap 23 to the post 21. An electrical cable 33, which may be as shown as crimped to a circular cable lug 34, is placed over the cable mounting post 29 and the clamp nut 30 is then screwed onto the post 29. The clamp nut 30 is then tightened onto the post 29 to fasten or clamp the electrical cable 33 securely to the cap 23 and post 21.

It will be appreciated that the clamp nut 30 can be replaced by a wing nut or other such nut that can be easily hand loosened or tightened, as required.

It is considered an advantage of the invention to provide a mounting cap 23 that mounts to the terminal post 21 of a battery, and wherein any further clamping and removal of electrical cable(s) to the post 21 can be undertaken without having to remove the cap 23.

Figure 5:
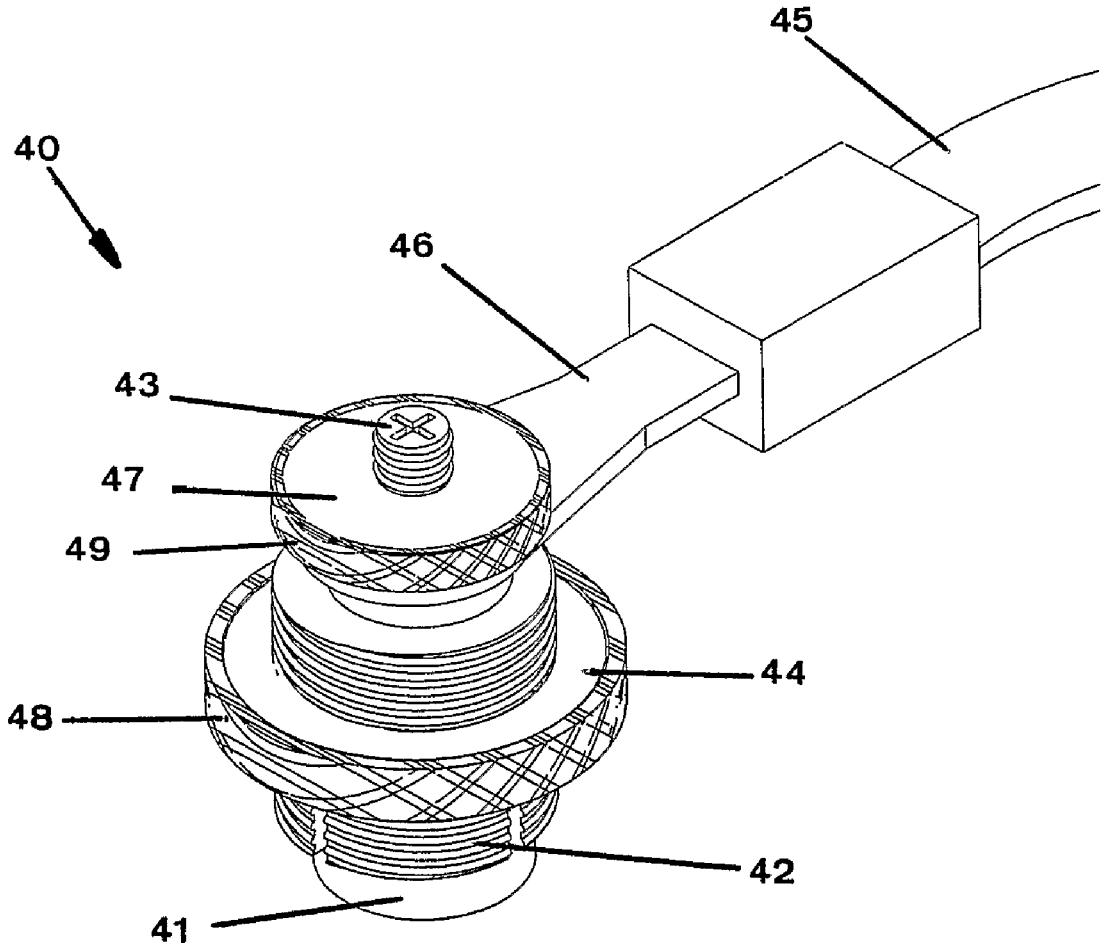
FIG. 5: Shows a perspective view of an assembled cable connector device 40 being substantially similar to the device 1 of FIG. 1 according to an alternative embodiment of the invention.

Referring now to FIG. 5, a perspective view of an assembled cable connector device 40 as mounted to a post 41 according to an alternative embodiment of the invention, is illustrated.

The device 40 is substantially similar to the device as described with reference to FIGS. 1 and 2 and many aspects will not be repeated. The device 40 includes a mounting cap 42 and associated cable mounting post 43. A cap clamping nut 44 fits over and clamps the cap 43 to the post 41. An electrical cable 45 is crimped with a lug 46 that is adapted to fit over the cable mounting post 43 and the internal thread of a cable clamping nut 47 is located about the post 43, in use, to tighten and clamp the lug 46 firmly to the top face of the cap 42.

The cap clamping nut 44 and/or the cable clamping nut 47 are advantageously adapted with an outer layer formed of a non conductive material 48, 49 respectively, that can serve to both increase the friction on the outer surfaces of the nuts 44, 47 and decrease the chances of a user being electrocuted by the electrical charge in the battery by forming an insulating layer between the skin of a user and the current flowing between the battery post 41 and electrical cable 45.

The non conductive material is any suitable durable and resilient material such as, for example, a rubber or synthetic rubber such as a suitable polychloroprene, a suitable polyvinyl chloride (PVC) or a suitable thermoplastics material moulded about the outer surface of the nuts 44, 47, or any suitable combination thereof. The material may desirably include heat resistant properties. The non conductive material may optionally be formed of a synthetic rubber or suitable layer of neoprene™ which may be modified by copolymerising chloroprene with other desirable compounds and suitably moulding the product about to be attached to the outer surface of the nuts 44, 47. A suitable pattern can be formed in the outer non conductive layer 48,49 similar to a knurling pattern to increase the friction of the surface of the layer 48,49 for hand tightening and loosening purposes.

It is seen in the figures that the devices 1,20, 40 form a strong robust connection of the electrical cable to the terminal post of a battery.

The devices 1,20 may be mostly made of any suitable conductive material such as steel and may include components formed from a conductive plastics material, and is preferably made of a highly conductive material such as brass, bronze, copper or the like.

Wherein the aforegoing reference has been made to integers or components having known equivalents, then such equivalents are herein incorporated as if individually set forth.

Accordingly, it will be appreciated that changes may be made to the above described embodiments of the invention without departing from the principles taught herein.

It is to be understood that the above description is intended to be illustrative, and not restrictive. Additional advantages of the present invention will become apparent for those skilled in the art after considering the principles in particular form as discussed and illustrated. Thus, it will be understood that the invention is not limited to the particular embodiments described or illustrated, but is intended to cover all alterations or modifications which are also within the broad scope of the invention as claimed.

The invention claimed is:

1. A cable connector device for use on a battery terminal post, the cable connector including a conductive mounting cap having an internal mounting wall with a surface area corresponding with the surface area of a said battery terminal post to enable, in use, the cap to be mountable onto the said battery terminal post, the mounting cap including a cable mounting post integral with or attachable to the mounting cap, the cable mounting post being adapted with a cable fastening means, in use, to receive and fasten an electrical cable to the device, the cable fastening means is a cable fastening nut made of a conductive material that is provided with an outer non-conductive layer forming an insulating barrier, the non-conductive layer of the cable fastening nut is made of a polychloroprene rubber or a thermoplastics material moulded substantially about the outer surface of the cable fastening nut, the non-conductive outer layer provided on the cable fastening nut being provided with a friction pattern to increase the friction on the outer surface of the cable fastening nut for use in allowing a user to hand tighten the cable fastening nut, and wherein the mounting cap is provided with at least one longitudinal slot, in use, to enable the mounting cap to be mounted on a terminal post.

2. A device according to claim 1 wherein the inner wall of the mounting cap is provided with a female thread on the inner wall of the mounting cap that is configured and arranged, in use, to cut an opposing thread on at least a portion of the said battery terminal post to enable the mounting cap to firmly attach to the said battery terminal post, the said battery terminal post being sufficiently malleable to allow an opposing thread to be formed.

3. A device according to claim 1 wherein the cable mounting post is circular in cross section and provided with an external thread adapted to receive a nut with an opposing thread for securing an electrical cable thereto.

4. A device according to claim 1 wherein the cable mounting post is substantially vertically aligned above the longitudinal axis of the mounting cap.

5. A device according to claim 1 wherein the cable fastening nut is provided with an internal thread corresponding with the thread provided on the outer portion of the cable fastening post.

6. A device according to claim 1 wherein the surface of the outer layer of the cable fastening nut is made of a durable and resilient non conductive material comprising a polyvinyl chloride material.

7. A device according to claim 1 wherein the cable mounting post is mounted at an angle of between 1 and 90 degrees to the vertical axis of the mounting post.

8. A device according to claim 1 wherein the mounting cap is provided with an external thread adapted to threadingly receive a ferrule nut with an opposing internal thread for securement of the mounting cap to the battery terminal post.

9. A device according to claim 8 wherein the inner wall of the mounting cap is provided with three or four spaced apart longitudinal slots in and about the mounting cap, in use, to enable the cap to be mountable on a battery terminal post that does not have a uniform cross section along the length of the mounting post.

10. A device according to claim 8 wherein the ferrule nut is made of a non-conductive material.

11. A device according to claim 8 wherein the ferrule nut is made of a conductive material, and wherein the ferrule nut is provided with an outer layer or surface, the outer layer being moulded with a non-conductive material provided substantially about the outer edge of the ferrule nut.

12. A device according to claim 8 wherein the outer layer of the ferrule nut is made of a durable and resilient non conductive material comprising a polychloroprene rubber or a polyvinyl chloride material.

* * * * *